US007137943B2

(12) United States Patent
Ferrara et al.

(10) Patent No.: US 7,137,943 B2
(45) Date of Patent: Nov. 21, 2006

(54) SHEET PREPARATION MODULE ARCHITECTURE AND CONTROL METHODS

(75) Inventors: Joseph J. Ferrara, Webster, NY (US); Richard A. Van Dongen, Newark, NY (US)

(73) Assignee: Xerox Corporation, Stamford, CT (US)

( * ) Notice: Subject to any disclaimer, the term of this patent is extended or adjusted under 35 U.S.C. 154(b) by 98 days.

(21) Appl. No.: 10/248,564

(22) Filed: Jan. 29, 2003

(65) Prior Publication Data

US 2004/0144221 A1 Jul. 29, 2004

(51) Int. Cl.
*B31B 1/14* (2006.01)
*B41F 13/58* (2006.01)

(52) U.S. Cl. ..... 493/361; 493/353; 493/356; 493/360; 270/5.03; 399/385

(58) Field of Classification Search ..... 473/353, 473/356, 361, 362, 363, 365, 369; 399/385; 270/5.02, 5.03; 493/11, 22; 83/304, 405, 83/373, 667, 682
See application file for complete search history.

(56) References Cited

U.S. PATENT DOCUMENTS 4,717,134 A 1/1988 Iida et al.
4,847,656 A * 7/1989 Kuno et al. ..... 399/84
5,076,556 A 12/1991 Mandel et al.
5,184,185 A * 2/1993 Rasmussen et al. ..... 399/130
5,207,412 A * 5/1993 Coons et al. ..... 270/1.02
5,232,147 A * 8/1993 Weinzierl et al. ..... 229/69
5,326,093 A * 7/1994 Sollitt ..... 271/306
5,342,034 A * 8/1994 Mandel et al. ..... 270/58.08
5,363,175 A * 11/1994 Matysek ..... 399/77
5,364,332 A 11/1994 Gray, Jr. et al.
5,709,376 A * 1/1998 Ushirogata ..... 270/58.11
5,852,765 A * 12/1998 Yamashita et al. ..... 399/407
5,911,414 A * 6/1999 Kato et al. ..... 270/58.07
6,010,122 A * 1/2000 Weber ..... 270/41
6,024,682 A 2/2000 Mandel et al.
6,217,497 B1 * 4/2001 Laudenberg ..... 493/11
6,264,594 B1 * 7/2001 Iddon ..... 493/356
6,435,395 B1 * 8/2002 Miyaguchi et al. ..... 227/27
6,526,256 B1 * 2/2003 Yoshie et al. ..... 399/407
6,635,001 B1 * 10/2003 Lynch et al. ..... 493/22
6,746,390 B1 * 6/2004 Tamura et al. ..... 493/445
2003/0160376 A1 * 8/2003 Yamada et al. ..... 270/58.07
2003/0215275 A1 * 11/2003 Tamura et al. ..... 399/407

* cited by examiner

OTHER PUBLICATIONS

"Canon Product Brochures" obtained from http://www.cfsystems.co.uk, available as of Apr. 30, 2002.

*Primary Examiner*—John Sipos
*Assistant Examiner*—Christopher R. Harmon
(74) *Attorney, Agent, or Firm*—Oliff & Berridge, PLC

(57) ABSTRACT

Sheets can be manipulated for punching, perforating and/or folding. The systems and methods according to this invention allow sheets to be punched and/or perforated in various configurations. The systems and methods according to this invention allow sheets to be folded in various forms and/or configurations. Sheets can be inverted to ensure proper orientation. The systems and methods according to this invention allow the number and/and or locations of punches and/or perforations and the type and/or length of folds to be controlled on a sheet-by-sheet basis. The systems and methods according to this invention allow the sheet preparation module to be optionally configured within the photocopying system depending on the needs and flexibility of the finishing requirements of the operator. The modularity of the sheet preparation module design as a "plug and play" unit enables greater functionality for the manipulation of sheets.

8 Claims, 7 Drawing Sheets

SHEET PREPARATION MODULE ARCHITECTURE AND CONTROL METHODS

BACKGROUND OF THE INVENTION

1. Field of Invention

This invention is directed to systems and methods for punching, perforating and folding of sheets in a printing system.

2. Description of Related Art

Photocopiers have become standard equipment in today's offices, enabling businesses to increase productivity and efficiency. Today's photocopying systems provide high-speed reproduction with ease of use. Additionally, current photocopying systems offer end-to-end capability from feeding to finishing that includes features such as sorting, collating and binding. Many systems combine several features to further increase productivity and ease of use by the operator.

Sheet folding systems are in use in many photocopying systems using various folding techniques, such as folding rollers and knife-edge folding assistance devices. Further, hole punchers, sheet perforators, and sheet inverters are used to enhance photocopying and document publication.

An important element of a photocopying system is the ability to handle large complicated print jobs with minimal user input. Systems exist that automate document handling, copying and finishing, such as hole punching, sheet perforation, and/or folding, with minimal user input. This reliability and ease of use further enables increases in user productivity. Such systems are needed that provide capabilities to photocopying systems.

SUMMARY OF THE INVENTION

However, few systems currently package the functional elements that handle the end-to-end copying requirements in a unique architecture.

This invention provides systems and methods for punching, perforating, and/or folding sheets for a printing system.

This invention separately provides systems and methods for punching sheets with various hole configurations.

This invention separately provides systems and methods for perforating sheets.

This invention further provides systems and methods for selectively folding sheets into different fold configurations.

In various exemplary embodiments of the systems and methods according to this invention, sheets can be manipulated for punching, perforating and/or folding. For example, sheets to be manipulated may be punched, or perforated or folded only. In other various exemplary embodiments, sheets can be punched and perforated only, punched and folded only, perforated and folded only, or punched, perforated, and folded.

In various exemplary embodiments of the systems and methods according to this invention, sheets can be punched in various punching configurations. For example, sheets can be punched with one hole, two holes, or three or more holes, based upon the punch and die units used in the system.

In various exemplary embodiments of the systems and methods according to this invention, sheets can be folded in various forms. For example, sheets can be z-folded for inserting larger sheets into small size sets, half-folded, c-folded, or z-folded for mailings, brochures, or for manually inserting ink envelopes. In various exemplary embodiments, sheets that are z-folded for insertion into a set can be inverted to ensure proper orientation.

In various exemplary embodiments of the systems and methods according to this invention, sheets can be stacked based on the type of manipulations performed. For example, z-folded and c-folded sheets not used in sets and/or half-folded sheets can be stacked in a top tray.

In various exemplary embodiments of the systems and methods according to this invention, the type and length of the fold can be controlled on a sheet-by-sheet basis. For example, the first copy of a photocopied sheet can be z-folded for mailing in an envelope and the second copy of the photocopied sheet can be half-folded for flyer manual distribution.

In various exemplary embodiments of the systems and methods according to this invention, the sheet preparation module can be optionally configured within the photocopying system depending on the need and flexibility of the finishing requirements of the operator. The modularity of the sheet preparation module design as a "plug and play" unit enables greater functionality for the manipulation of sheets. For example, the sheet preparation module can be situated to accept output sheets from an image output terminal or from a sheet feed module. Sheets from the sheet preparation module can be sent to a finisher to be incorporated into sets or stacks or sheets can be redirected to a top tray of the sheet preparation module.

These and other features and advantages of this invention are described in, or are apparent from, the following detailed descriptions of various exemplary embodiments of the systems and methods according to this invention.

BRIEF DESCRIPTION OF THE DRAWINGS

Various exemplary embodiments of the invention will be described in detail with reference to the following figures, wherein.

DETAILED DESCRIPTION OF EXEMPLARY EMBODIMENTS

Various exemplary embodiments of the systems and methods according to this invention enable the manipulation of sheets in a photocopying system to be advanced by using a sheet preparation module. The mechanisms and techniques used in sheet preparation modules according to this invention provide a combination of punching, perforating, and/or folding.

In various exemplary embodiments of the systems and methods of this invention, a sheet fed into the sheet preparation module can be effectively manipulated based upon the requirements of a particular job submitted by an operator of the printing or photocopying system. It should be appreciated that sheets requiring no manipulation can be bypassed through the sheet preparation module to a downstream module, such as, for example, a finisher module.

In various exemplary embodiments, sheets may be punched with varying configures of holes using replaceable punch/die configurations. It should be appreciated that punched sheets can also be folded and/or perforated.

In various exemplary embodiments, sheets may be perforated in various locations. The locations of the perforation on the sheet are fully controllable on a sheet-to-sheet basis.

In various exemplary embodiments, sheets may be folded in various configurations based on the operator requirements. Sheets may be z-folded, c-folded, and half-folded for letters, brochures, cards and the like. In various exemplary embodiments, the type of folding and the position of the one or more folds on the sheet relative to the edges of the sheet and/or other folds are fully controllable on a sheet-to-sheet basis.

In various exemplary embodiments, sheets diverted to the sheet preparation module for manipulation are registered to ensure proper alignment of the sheet prior to manipulation using a tamping system. The sheet, after registration, may be punched. The sheet may then be transported out of the registration and punch area and transported to a perforator unit. In various exemplary embodiments, a rotary perforation wheel with a backer roll is used to perforate the sheet. In various exemplary embodiments, the perforation wheel and backer may be moved, for a given sheet, to the appropriate cross-process location before the sheet arrives. In various exemplary embodiments, the perforation wheel and backer engage the sheet only when required. After being perforated, the sheet may then pass to a folding area. The type of fold performed on the sheet, such as z-folds, c-folds, and half-folds, and the like, may be predicated on the requirements of the system operator. After folding, sheets may be sent to a finisher module or exit to a top tray of the sheet preparation module.

It should be appreciated that the type of punching, perforating, and folding may vary and/or differ on a job-to-job basis or even on a sheet-to-sheet basis, depending on the requirements of the system operator.

Figure 1:
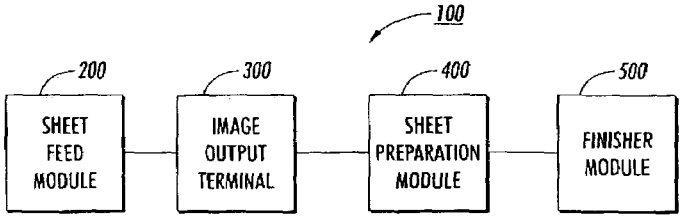
FIG. 1 is a block diagram of one exemplary embodiment of a photocopying system usable with various exemplary embodiments of the systems and methods according to this invention.

FIG. 1 is a block diagram of one exemplary embodiment of a photocopying system 100 usable to process and manipulate a sheet. As shown in FIG. 1, the photocopying system 100 includes a sheet feed module 200, an image output terminal 300, a sheet preparation module 400, and a finisher module 500.

It should be appreciated that in various exemplary embodiments, these elements, while shown in FIG. 1 as separate elements, are not necessarily separate and distinct components. Thus, the functions and/or operations of any one or more of these elements may be carried out by a single device, structure and/or subsystem. Furthermore, it should be appreciated that the sheet preparation module 400 in FIG. 1 may be located or positioned within the photocopying system 100 to accept sheets from the image output terminal 300 or from the sheet feed module 200, for example.

Figure 2:
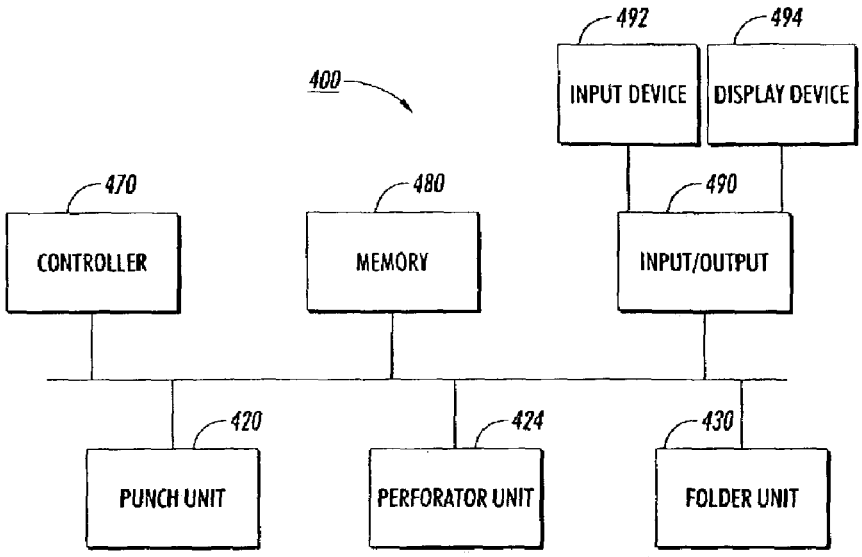
FIG. 2 is a block diagram of one exemplary embodiment of the sheet preparation module for the photocopier system of FIG. 1.

FIG. 2 is a block diagram of one exemplary embodiment of a sheet preparation module 400 according to this invention for the photocopying system 100. As shown in FIG. 2, the sheet preparation module 400 includes one or more of a controller 470, a memory 480, an input/output interface 490, a punch unit 420, a perforator unit 424, and a folder unit 430 connected together by one or more control and/or data busses and/or one or more application programming interfaces 475.

The memory 480 shown in FIG. 2 can be implemented using any appropriate combination alterable, volatile or non-volatile memory, or non-alterable, or fixed memory. The alterable memory, whether volatile or non-volatile can be implemented using any one or more ecstatic or dynamic brand, a floppy disc or disc drive, a writeable or rewriteable optical disc and disc drive, a hard drive, a flash memory or the like. Likewise, the non-alterable or fixed memory can be implemented using any one or more ROM, PROM, EPROM, EEPROM and optical disc, ROM, disc such as CD-ROM or DVD-ROM, and disc drive or the like.

As shown in FIG. 2, one or more input device 492 and display devices 494 are connected to the input/output interface 490. In general, the one or more input devices 492 will include any one or more of a keyboard, a keypad, a touch screen, or any other known or later developed system for providing control and/or data signals to the sheet preparation module 400. The one or more input devices 492 can further include any manual or automated device usable by a user or other system to present data or other stimuli to the sheet preparation module 400.

The punch unit 420 can be any hardware system, device or apparatus that enables the sheet preparation module 400 to punch holes in sheets. In various embodiments, the punch unit 420 can include any combination of any combination of hardware elements, such as punch and die units, servos and/or solenoids that provide any combination of punch holes.

The perforator unit 424 can be any combination of hardware elements that enables sheets in the sheet preparation module 400 to be perforated. In various embodiments, the perforation unit 424 can include a combination of hardware, including a rotary perforation wheel with a backer roll.

The folder unit 430 can be any combination of hardware elements that enables the sheet in the sheet preparation module 400 to be folded. In various exemplary embodiments, the folder unit 430 can include any hardware elements, such as one or more simple buckle folders, one or more sets of drive rollers, one or more sets of servo control nip rollers and/or and one or more sets of folder fold rollers that enable various types of folds to be controllably applied to each sheet on a sheet-to-sheet basis. The type of folds performed by the folder unit 430 may include, but is not limited to, c-folds, z-folds, and half-folds.

Figure 3:
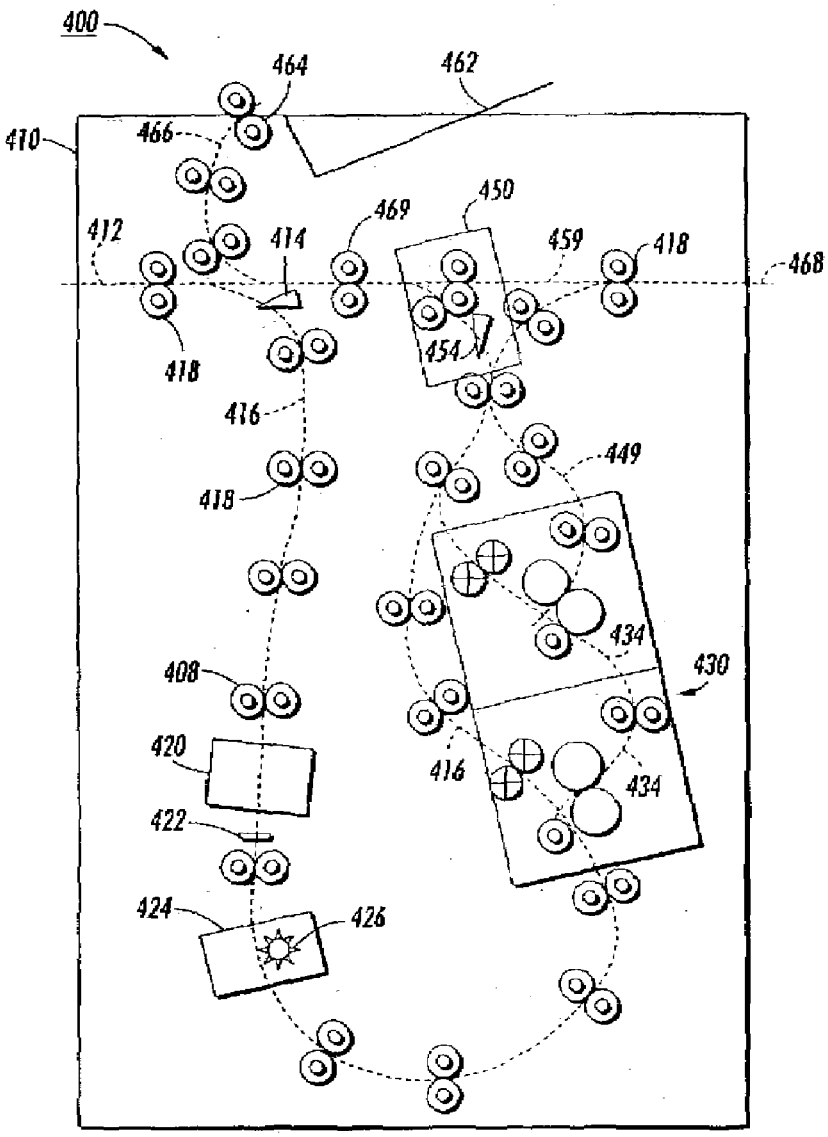
FIG. 3 is a block diagram of one exemplary embodiment of a the sheet preparation module.

FIG. 3 is a diagram of one exemplary embodiment of the sheet preparation module 400. As shown in FIG. 3, the sheet preparation module 400 includes a sheet-receiving inlet 412, a bypass path 459, and a sheet-discharging outlet 468. One or more sets of transport nip rollers 418 and/or 469 move the sheets along the bypass path 459.

A sheet to be manipulated is diverted from the bypass path 459 to a primary manipulation path 416 by a gate 414. As shown in FIG. 3, the primary manipulation path 416 includes one or more sets of transport nip rollers 418, one or more sets of nip rollers 408, the punch unit 420, a leading edge registration gate 422, the perforator unit 424, and the folder unit 430.

As discussed above, sheets to be manipulated are diverted from the bypass path 459 to the manipulation path 416 by the gate 414. One or more sets of transport nip rollers 418 move the sheets along the manipulation path 416 to the registration gate 422. The registration gate 422 registers the leading edge of the sheet. Cross-process registration, if implemented, is accomplished using a tamping system, for example. For cross-process registration, the one or more sets of nip rollers 408 are opened to allow the sheet movement in the cross-process direction. After a sheet has been registered to ensure proper alignment, the sheet may be punched by the punch unit 420. The sheet is transported out of the registration gate and punch area to the perforation unit 424. If the sheet is to be perforated, in various exemplary embodiments a fully controllable rotary perforation wheel 426 performs the perforation. The perforation wheel 426 can be moved to the appropriate cross-process location prior to the arrival of the sheet and the perforation wheel 426 being engaged.

From the perforation area, the sheet continues along the manipulation path 416 to the folding unit 430. The folding unit 430 includes an initial folding area and a second folding area, enabling a multiple of fully controllable folding options. In various exemplary embodiments, the sheet may be z-folded, half-folded and c-folded, for example.

If a sheet does not require folding, the sheet continues along the manipulation path 416 and may exit the sheet preparation module 400 via the sheet-discharging outlet 468. Alternatively, sheets can continue to a tray path 466 leading to a tray exit 464 and a top tray 462.

A sheet that requires folding enters the folding unit 430 along the primary manipulation path 416 and extends into the initial folding area. If only a single fold is required, the sheet continues along the initial folding path 434, by-passing the second folding area, and exits the folding unit 430. If additional folding is required, the sheet stops in the second folding area and is directed along the second folding path 449. After folding, the sheet exits the folding unit 430. In contrast, folded sheets not sent to the finisher module 500 can be directed to the top tray 462 of the sheet preparation module 400 via the exit path 466 to the tray outlet 464.

Figure 4:
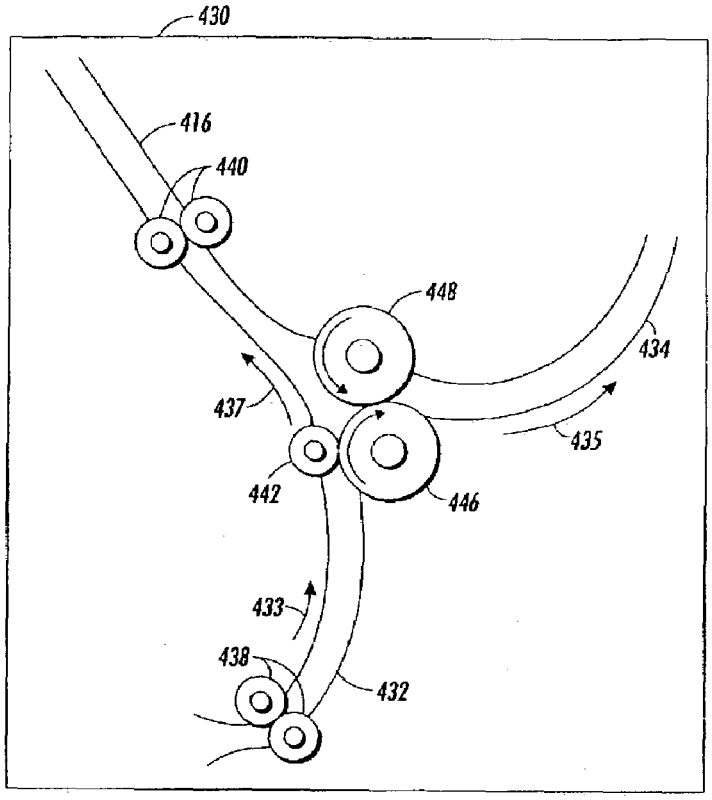
FIG. 4 shows in greater detail one exemplary embodiment of the folder unit of the sheet preparation module of FIGS. 2 and 3.

FIG. 4 shows in greater detail one exemplary embodiment of the folding unit 430. As shown in FIG. 4, the folding unit 430 includes fold rollers 446 and 448, one or more sets of servo control nip rollers 440, and a drive roller 442. An additional set of fold rollers, one or more sets of servo control nip rollers and a drive roller are situated in the folding unit 430 to provide a second fold. Although the first set of fold rollers and one or more sets of control nip rollers are described here, it should be appreciated that both sets of fold rollers and control nip rollers operate in the same manner.

As shown in FIG. 4, the fold rollers 446 and 448 can be simple buckle folders. The one or more sets of servo control nip rollers 440 can be any type of controllable rollers that can be, for example, stopped and reversed. It should be appreciated that a moveable gate can also be used in addition to, or even in place of, the nip rollers 440. That is, in various exemplary embodiments, the moveable gate can be moved along the manipulation path to change where the sheet is stopped relative to the fold rollers 446 and 448 to change where the fold is formed along the length of the sheet along the manipulation path 416.

The sheet to be folded by the sheet preparation module 400 is driven along the manipulation path 416 by the one or more sets of servo control rollers 438 to the folding unit 430 and the fold rollers 446 and 448. The sheet continues along 416 to the one or more sets of servo control nip rollers 440. The sheet enters the one or more sets of servo control nip rollers 440, which drive the leading edge of the sheet forward until the desired fold positions is at the fold roll location between the fold rollers 446 and 448. The one or more sets of servo control nip rollers 440 are quickly reversed, driving the lead edge of the sheet backwards. The trailing edge of the sheet is driven forward by the drive roller 442, causing the sheet to buckle into the fold rollers 446 and 448. The fold rollers 446 and 448 acquire the sheet by the fold roller 446 rolling clockwise and the fold roller 448 rotating counter-clockwise. This motion of the fold rollers 446 and 448 causes a fold to be made into the sheet. The folded sheet continues along the fold path 434 to the second folding area of the folding unit 430.

In the second folding area, a second fully controlled fold, if needed, is performed using the same technique used in the initial folding area. It should be appreciated that the folding controls in both the initial fold area and second fold area allow any number of fold positions to be performed on a sheet-by-sheet basis and enable the folding of different sized sheets.

It should be appreciated that, if two folds are to be formed in the sheet, the type of fold, such as z-fold or c-fold, is controlled by selecting the location where the first fold is formed along the length of the sheet, where the length is the dimension of the sheet along the manipulation path 416. That is, when the folded sheet exits the first set of fold rollers 446 and 448, the fold becomes the leading edge of the sheet. If the first fold is formed closer to the original leading edge than to the trailing edge, a first flap portion of the sheet formed by the fold will be on the side of the sheet facing the fold roller 448. In various exemplary embodiments, if the first and second fold areas are arranged as shown in FIG. 3, when the sheet is driven into the fold rollers of the second folding area, the first flap portion of the sheet formed by the first set of fold rollers 446 and 448 will be on the same side of the sheet from a second flap portion of the sheet formed by the fold rollers of the second fold area. As a result, a c-fold is formed in the sheet.

If the first fold is formed closer to the trailing edge than to the original leading edge, the first flap portion of the sheet formed by the fold will be on the side of the sheet facing the fold roller 446. In various exemplary embodiments, if the first and second fold areas are arranged as shown in FIG. 3, when the sheet is driven into the fold rollers of the second folding area, the first flap portion of the sheet formed by the first set of fold rollers 446 and 448 will be on the opposite side of the sheet from a second flap portion of the sheet formed by the fold rollers of the second fold area. As a result, a z-fold is formed in the sheet. It should be appreciated that, if the second folding area is arranged differently, the relative locations where the first fold is formed along the sheet to obtained a c-fold and a z-fold could be reversed.

A sheet not requiring a second fold continues along the fold path 434 to the inverter area 450. A sheet requiring a second fold exits the folding unit 430 via the second fold path 449 to the inverter area 450.

Figure 5:
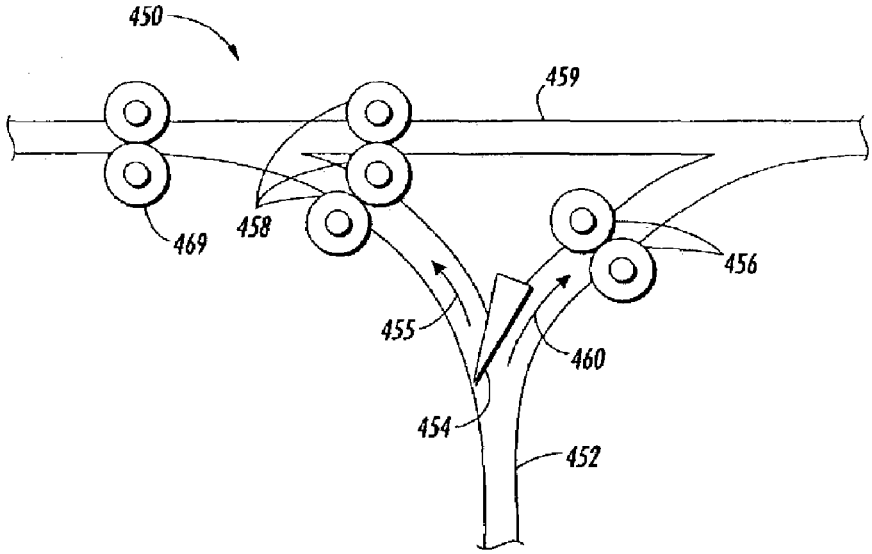
FIG. 5 shows in greater detail an exemplary embodiment of the inverter unit of the sheet preparation module of FIGS. 2 and 3.

Sheets can be inverted prior to being sent to the finisher module 500. FIG. 5 depicts an inverter 450 for the sheet preparation module 400. The inverter 450 includes an inverter path 455 and an inverter gate 454. One or more sets of transport nip rollers 456 and 458 are aligned with an exit path 460 and the inverter path 455 to control the sheet along both paths.

A sheet to be output through a sheet discharging outlet 468 that will not be inverted continues from the manipulation path 452 through the exit path 460 to the bypass path 459. In the bypass path 459, the sheet is then ejected from the sheet preparation module 400 via the sheet-discharging outlet 468. A sheet not inverted can also continue from the manipulation path 452 through the inverter path 45.5 and then be transported along the bypass path 459 to the tray path 466 by opening the gate 454. The sheet is then ejected from the sheet preparation module 400 to the top tray 462 via the tray exit 464.

A sheet is inverted to change its orientation. In general, the orientation is changed to swap the leading edge for trailing edge, that is, so that the trailing edge before inversion becomes the leading edge after inversion. For a sheet that is to be sent to the sheet discharging outlet 468 to be inverted, the inverter gate 454 is opened to divert the sheet into the inverter path 455. The sheet is transported along the inverter path 455 by the one or more sets of transport nip rollers 458 to the bypass path 459 and into one or more sets of servo controlled nip rollers 469. When the sheet is fully on the bypass path 459, the one or more sets of servo controlled nip rollers 469 reverse and send the sheet back along the bypass path 459 towards the exit 468. The sheet can then be ejected from the sheet preparation module 400 by transporting it back along the bypass path 459 to the sheet-discharging outlet 468.

In various exemplary embodiments, it is also possible to invert as sheet that is to be output to the top tray 462. To invert such a sheet, the inverter gate 454 remains closed to divert the sheet into the exit path 460 and onto the bypass path 459 towards the exit 468. The sheet is transported along the bypass path 459 to one or more sets of transport nip rollers positioned along the bypass path 459. When the sheet is fully on the bypass path 459, these one or more sets of transport nip rollers then reverse to drive the sheet to the one or more sets of servo controlled nip rollers 469. The one or more sets of servo controlled nip rollers 469 are then driven to send the sheet along the tray path 466 towards the exit 464 to eject the sheet from the sheet preparation module 400 into the top tray 462.

Figure 6:
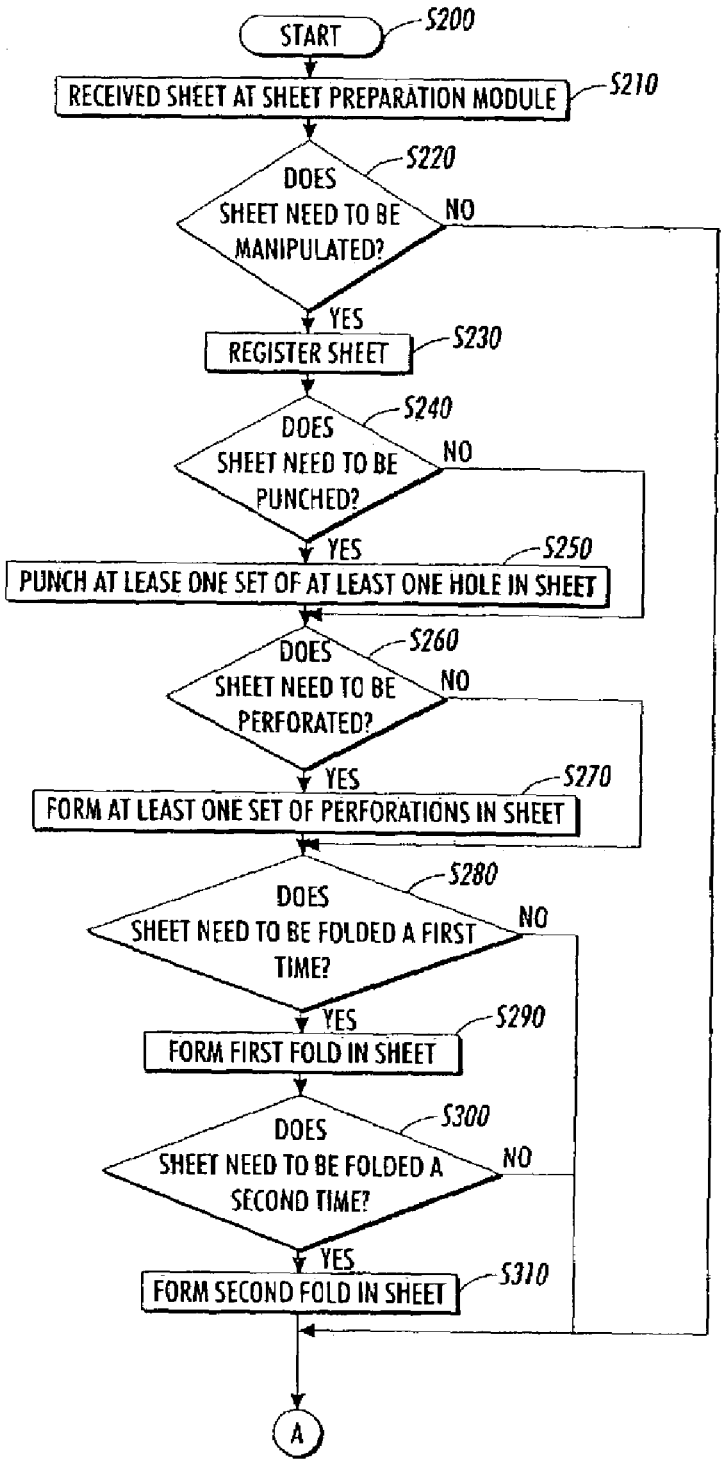
FIGS. 6 and 7 are a flowchart outlining an exemplary embodiment of a method for manipulating a sheet using the sheet preparation module.
Figure 7:
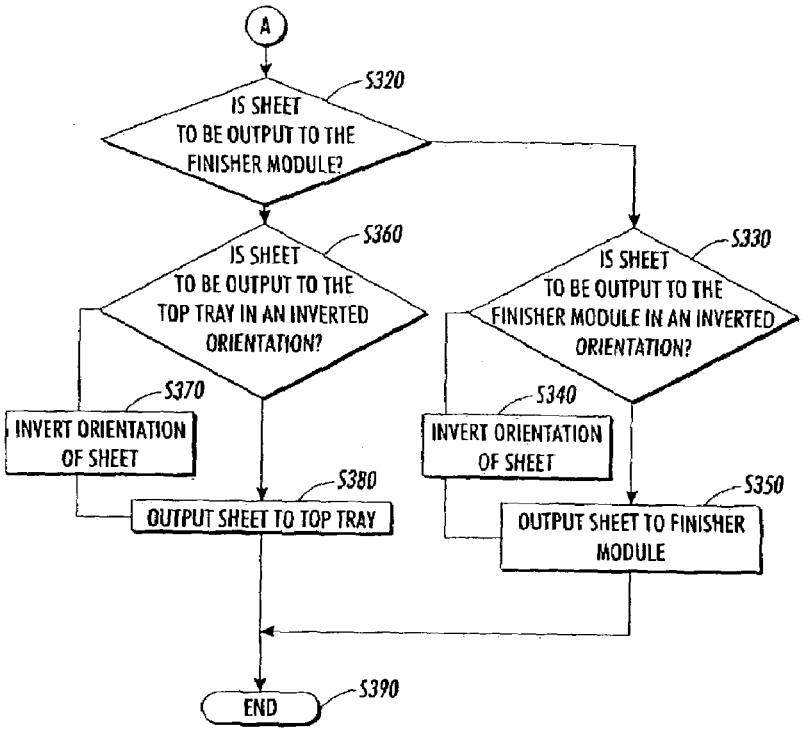

FIGS. 6 and 7 are a flowchart outlining one exemplary embodiment of a method for man ipulating a sheet using any of various exemplary embodiments of a sheet preparation module according to the invention. Beginning in steps S200, operation continues to step S210, where the sheet preparation module receives a sheet from an image output terminal. Then, in step S220, a determination is made whether the sheet is to be manipulated. If the sheet is to be manipulated, operation continues to step S230. Otherwise, operation jumps to step S330.

In step S230, the sheet is registered to ensure the sheet is properly aligned prior to manipulation. Next, in step S240, a determination is made whether the sheet is to be punched. If the sheet is punched, operation continues to step S250. Otherwise, the sheet passes through a sheet punch unit without being punched and operation jumps to step S260. In step S250, the sheet is punched one or more times to form one or more sets of holes within the sheet. Then, in step S260, a determination is made whether the sheet is to be perforated. If the sheet is to be perforated, operation continues to step S270. Otherwise, the sheet passes through the sheet perforation unit without being perforated and operation jumps to step S280.

In step S270, the sheet is perforated to form one or more lines of perforation in the sheet. Next, in step S280 a determination is made whether the sheet is to be folded to form a first fold. If the sheet is to be folded, operation continues to step S290. Otherwise, the sheet passes through the sheet fold unit without being folded and operation jumps to step S320. In step S290, the sheet is folded to form a first fold. Then, in step S300, a determination is made whether a second fold is to be formed in the sheet. If so, operation continues to step S310. Otherwise, the sheet passes through the second fold portion of the sheet fold unit without being folded a second time and operation jumps to step S320. In step S310, the sheet is folded a second time. Operation then continues to step S320.

In step S320, a determination is made whether the sheet is to be output to the finisher module. If the sheet is to be output to the finisher module, operation continues to step S330. Otherwise, operation jumps to step S360. In step S330, a determination is made whether the sheet is to be inverted. If the sheet is to be inverted, operation continues to step S340. Otherwise, operation jumps directly to step S350. In step S340, the sheet is inverted. Then in step S350, the sheet is output from the sheet preparation module to the finisher module. Operation then jumps to step S390.

In contrast, in step S360, a determination is made whether the sheet is to be inverted. If the sheet is to be inverted, operation continues to step S370. Otherwise, operation jumps directly to step S380. In step S370, the sheet is inverted. Then in step S380, the sheet is output from the sheet preparation module into an output tray or the like. Operation then continues to step S390, where operation of the method ends. Of course, it should be appreciated that, if inverting the sheet that is to be output to the output tray is not implemented, steps S360 and S370 are omitted and, in step 5380, the uninverted sheet is output to the output tray or the like.

While this invention has been described in conjunction with various exemplary embodiments, it is to be understood that many alternatives, modifications and variations would be apparent to those skilled in the art. Accordingly, the preferred embodiments of this invention, as set forth above are intended to be illustrative, and not limiting. Various changes can be made without departing from the spirit and scope of this invention.

What is claimed is:

1. A sheet preparation system, comprising:

an image forming device;

an input path that communicates with the image forming device and receives a sheet from the image forming device;

a sheet preparation module that individually processes sheets received from the image forming device, the sheet preparation module comprising:

a hole forming device that controllably creates at least one hole in the received sheet, a perforating device that controllably creates at least one perforation in the received sheet, and a folding subsystem having multiple folding areas to selectively control folding alternating sheets in a desired configuration from among a plurality of fold-types and fold positions; and an output path that outputs the received sheet from the sheet preparation module, wherein the sheet preparation module includes a manipulation path for directing a sheet to of the hole forming device, the perforating device, or the folding subsystem, and a bypass path to allow the received sheet to bypass the hole forming device, the perforating device, and the folding subsystem, of the sheet preparation module, wherein the folding subsystem is further controllable to selectively locate a selected number of folds in the received sheet and comprises a first folding device and a second folding device, and each of the first and second folding devices comprises:

a set of folding rollers, and a set of servo rollers that is controllable to reverse a direction of the received sheet at a selectable location that determines a location of a fold to be formed in the received sheet by a set of drive rollers.

2. The sheet preparation system of claim 1, further comprising a sheet registration device that registers the sheet before the sheet is provided to the folding subsystem, the hole forming device and the perforating device.

3. The sheet preparation system of claim 1, wherein the hole forming device is controllable to selectably locate a selected number of holes in the received sheet.

4. The sheet preparation system of claim 3, wherein the hole forming device is further controllable on a sheet-by-sheet basis.

5. The sheet preparation system of claim 1, wherein the perforation device is further controllable to selectively locate a selected number of perforations in the received sheet.

6. The sheet preparation system of claim 5, wherein the perforation device is controllable on a sheet-by-sheet basis.

7. The sheet preparation system of claim 1, wherein the folding subsystem is controllable on a sheet-by-sheet basis.

8. The sheet preparation system of claim 1, wherein the perforation device comprises a rotary perforation wheel that is movable relative to the received sheet to a desired cross-process location.

* * * * *